United States Patent [19]

Harrison et al.

[11] 4,115,245

[45] Sep. 19, 1978

[54] SOLVENT DEWAXING PROCESS

[75] Inventors: Charles W. Harrison; Leonard R. Watts, both of Nederland, Tex.

[73] Assignee: Texaco Inc., New York, N.Y.

[21] Appl. No.: 813,145

[22] Filed: Jul. 5, 1977

[51] Int. Cl.[2] ..... C10G 43/08

[52] U.S. Cl. ..... 208/33; 208/37

[58] Field of Search ..... 208/33

[56] References Cited

U.S. PATENT DOCUMENTS

| | | | |
|---|---|---|---|
| 2,410,483 | 11/1946 | Dons et al. | 208/37 |
| 3,720,599 | 3/1973 | Gould | 208/33 |
| 3,764,517 | 10/1973 | Bodemuller | 208/33 |

OTHER PUBLICATIONS

Chen et al., "Chemical Engineering", Mar. 19, 1973, pp. 105 to 111.

*Primary Examiner*—Herbert Levine

*Attorney, Agent, or Firm*—Douglas H. May, Jr.; Carl G. Ries; Thomas H. Whaley

[57] ABSTRACT

A solvent dewaxing process wherein an intermediate range waxy distillate oil, heated for dissolving all wax therein, is mixed with about 1–4 volumes dewaxing solvent having a temperature in the range of 60°–80° F for forming an oil-solvent mixture having a temperature below depressed cloud point. The oil-solvent mixture is subsequently cooled at 1°–8° F/min to a selected separation temperature for precipitating wax and forming a first wax/oil/solvent mixture. Additional solvent, at about the separation temperature, is mixed with first wax/oil/solvent mixture in an amount equivalent to about 1–2 volumes of waxy oil charge for precipitating additional wax and forming a second wax/oil/sovent mixture. Precipitated wax is separated, at said separation temperature from said second wax/oil/solvent mixture.

4 Claims, 1 Drawing Figure

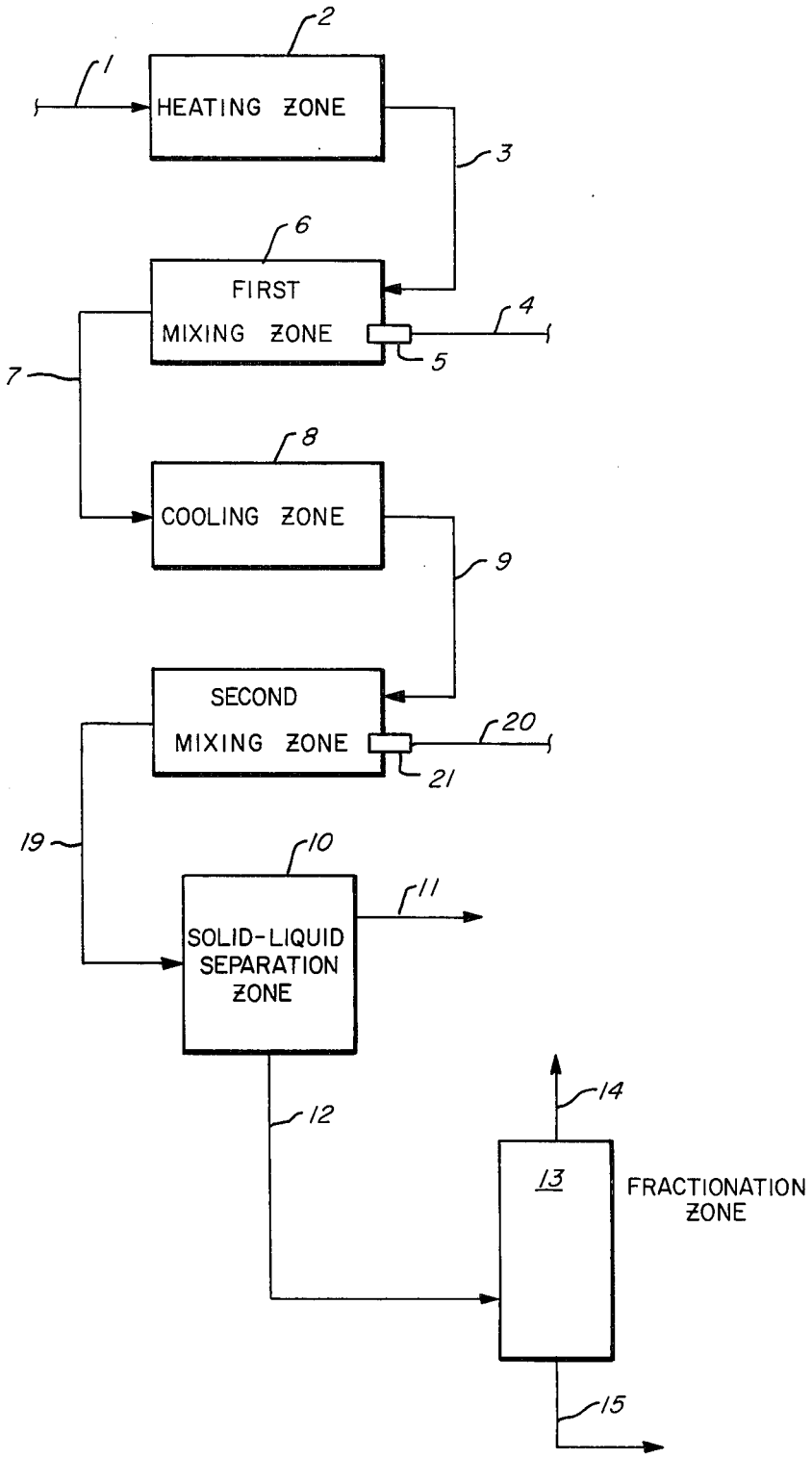
1
2
HEATING ZONE
3
6
FIRST
MIXING ZONE
4
5
7
8
COOLING ZONE
9
SECOND
MIXING ZONE
20
21
19
10
SOLID-LIQUID
SEPARATION
ZONE
11
12
14
13
FRACTIONATION
ZONE
15

SOLVENT DEWAXING PROCESS

BACKGROUND OF THE INVENTION

The present invention relates to solvent dewaxing processes for dewaxing waxy distillate petroleum oil stocks. More particularly, the invention relates to a solvent dewaxing process wherein wax is precipitated from a waxy oil stock by direct contact with cool dewaxing solvent followed by cooling the resulting wax-/oil/solvent mixture by indirect heat exchange to a selected separation temperature. Viscosity of the wax-/oil/solvent mixture is adjusted for improved wax separation by adding additional dewaxing solvent to the wax/oil/solvent mixture at the separation temperature.

DESCRIPTION OF THE PRIOR ART

It is known in the prior art to dewax waxy petroleum oil stocks by cooling oil-solvent solutions at uniformly slow rates, of e.g. 1°–8° F/minute (0.56°–4.4° C/min.), under controlled conditions for crystallization of wax from said solutions. Commercially, such oil-solvent solutions are cooled by several methods such as indirect heat exchange in scraped surface exchangers; dilution chilling wherein waxy oil stock is contacted in a multistage tower with chilled solvent under conditions of high levels of agitation (U.S. Pat. No. 3,773,650); and direct chilling, wherein a low boiling solvent, e.g., propylene, mixed with waxy oil stock is vaporized under conditions of reduced pressure.

In such commercial processes, the waxy oil charge, or solutions of waxy oil charge and solvent, are heated to a temperature at which all the wax present is dissolved. The heated charge is then passed into a cooling zone wherein cooling is undertaken at a uniform slow rate in the range of about 1°–8° F/minute (0.56°–4.4° C/min.) until a temperature is reached at which a substantial portion of the wax is crystallized and at which dewaxed oil product has a selected pour point temperature. Upon achieving the desired dewaxing temperature, the mixture of wax crystals, oil and solvent is subjected to solid-liquid separation for recovery of a wax free oil-solvent solution and a solid wax containing a minor proportion of oil (slack-wax). The separated oil-solvent solution is subjected to fractional distillation for recovery of a solvent fraction and a dewaxed oil product fraction. The slack wax may be recovered as is, or may be subjected to additional processing, such as repulp filtration for removal of additional oil therefrom.

Solid-liquid separation techniques which may be employed for separation of wax crystals from the oil-solvent solutions include known solid-liquid separation processes, such as gravity settling, centrifugation, and filtration. Most commonly, in commercial processes, filtration in a rotary vacuum filter, followed by solvent wash of the wax cake, is employed.

Dewaxing solvents which may be used in solvent dewaxing processes include known dewaxing solvents. Commonly used solvents include aliphatic ketones of 3–6 carbon atoms, $C_2$–$C_4$ range hydrocarbons, $C_6$–$C_7$ aromatic hydrocarbons, halogenated $C_1$–$C_4$ hydrocarbpns, and mixtures of such solvents. Solvent dilution of waxy oil stocks maintains fluidity of the oil for facilitating easy handling, for obtaining optimum wax-oil separation, and for obtaining optimum dewaxed oil yields. The extent of solvent dilution depends upon the particular oil stocks and solvents used, the approach to filtration temperature in the cooling zone and the desired final ratio of solvent to oil in the separation zone.

For processes employing indirect cooling in scraped surface exchangers, cooling and wax crystallization are accomplished under conditions of very little agitation at a cooling rate in the range of about 1°–8° F/minute (0.56°–4.4° C/min.). Under such conditions, without wall scrapers, wax tends to accumulate on the cold exchanger walls interferring with heat transfer, and causing increased pressure drop. Thus, scrapers are employed to maintain fluidity of the oil in the coolers, and may be added before the oil is cooled or in increments during cooling. Often the oil is given a final dilution with solvent at the separation temperature for reducing solution viscosity such that wax separation is more efficient. Commonly, solvent added to the oil in such processes is at the same temperature, or somewhat higher temperature than the oil. Cold solvent, added at substantially lower temperatures than the oil, shock chills the oil resulting in formation of many small wax crystals which are difficult to separate. Under controlled conditions, elongated wax crystals of good size are formed which are easy to separate and which contain little occluded oil.

Dilution chilling processes employ incremental addition of cold solvent, at about the separation temperature or lower, to the oil under conditions of high agitation such that oil and solvent are completely mixed in less than one second. Under such conditions, wax precipitates in small, hard balls rather than elongated crystals. Such wax precipitates are easy to separate and retain very little oil.

Direct chilling processes employ a low boiling hydrocarbon, e.g., propylene, as dewaxing solvent and refrigerant. Waxy oil stock is diluted with sufficient low boiling hydrocarbon to provide the necessary cooling and provide the desired final dilution for separation of solid wax from the oil-solvent solution. The low boiling hydrocarbon is vaporized from the oil-low boiling hydrocarbon solution under conditions of reduced pressure, at a rate sufficient to cool the solution about 1°–8° F per minute (0.56°–4.4° C/min.). Such cooling is continued until the desired separation temperature and amount of wax crystallization are obtained. At the separation temperature, sufficient low boiling hydrocarbon remains in solution with the oil to provide the desired fluidity for good separation of wax. Agitation of the mixture being cooled is commonly provided for reduction of temperature and concentration gradients.

In these processes of the prior art, rotating mechanical equipment, either wall scrapers or high speed agitators, are employed to facilitate good heat transfer from the oil. Such mechanical equipment is expensive, difficult to maintain, and can contribute to breaking and deformation of wax crystals.

SUMMARY OF THE INVENTION

Now, according to the present invention, we have discovered an improved continuous solvent dewaxing process for separating solid wax from a waxy distillate petroleum oil stock. The improvement of the present invention is applicable to a continuous solvent dewaxing process for separating wax from a waxy distillate oil stock wherein said waxy oil stock is treated with dewaxing solvent in a solvent to oil volume ratio of from about 1:1 to about 5:1 to form an oil-solvent mixture, wherein said oil solvent mixture is cooled to a selected separation temperature for crystallizing wax, wherein solid wax is separated from the oil/solvent mixture in a solid-liquid separation zone, and wherein oil-solvent mixture, free of crystallized wax from said solid liquid separation zone is fractionated in a fractionation zone to yield a solvent fraction and a dewaxed oil fraction of reduced pour point; the improvement of the present invention comprises:

(a) heating, in a heating zone, said waxy oil stock to a temperature in the range of about 85° to 160° F (29° to 71° C) at which all solid wax is dissolved;

(b) mixing, in a first mixing zone, said heated waxy oil stock with a first dewaxing solvent having a temperature in the range of 50°–80° F (10° to 27° C), in a solvent to oil ratio of from about 1:1 to about 4:1 under conditions of plug flow radial mixing for producing a first oil-solvent mixture, having a temperature below the depressed cloud point, and having wax crystal nuclei homogeneously mixed therein;

(c) cooling, in a cooling zone, said first oil-solvent mixture at a uniform rate of about 1°–8° F/min. (0.56°–4.4° C/min.) to said selected separation temperature, in the range of about 0° to −40° F (−18° to −40° C), for crystallizing additional wax and forming a wax/oil/solvent mixture;

(d) mixing, in a second mixing zone, said wax/oil/solvent mixture from step (c) with an amount of solvent equivalent to about 1–2 volumes waxy oil charge, under conditions of plug flow radial mixing, at said separation temperature, for precipitating additional wax and maintaining fluidity of the wax/oil/solvent mixture; and e) flowing said wax-/oil/solvent mixture, at said separation temperature, from said second mixing zone to said solid-liquid separation zone.

Advantages of the present invention over processes of the prior art include elimination of rotating mechanical equipment for providing mixing in said first and second mixing zones, as well as in said cooling zone. Additionally, when plug flow radial mixing is employed in said cooling zone heat transfer from said oil-solvent solution is improved, transverse temperature gradients in the flowing oil-solvent solution are reduced, and wax crystal nuclei are homogeneously distributed within the flowing oil-solvent mixture.

Elimination of rotating mechanical equipment such as agitators, wall scrapers in scraped surface exchangers, etc., reduces cost of constructing solvent dewaxing facilities and reduces manpower, expense, and downtime required for operating and maintaining such rotating mechanical equipment.

Improved wax crystal nuclei distribution in the oil-solvent reduces mass-transfer effects which retard wax crystal growth.

In the case where plug flow radial mixing is employed in the cooling zone, wherein cooling is by indirect heat exchanges from said oil-solvent mixture to a refrigerant fluid, improved heat transfer from the oil-solvent mixture to the refrigerant fluid reduces operating costs by improving efficiency of the cooling zone.

However, the greatest advantage is that transverse temperature differentials across the cross-sectional area of flowing oil-solvent mixture are reduced to about 1° F (0.56° C) or less, such that substantial subcooling of portions of the oil-solvent mixture close to the cold walls of the cooling zone is avoided, thereby reducing deposition of solid wax upon said cold walls. These advantages and others will be explained more fully in the detailed description which follows.

BRIEF DESCRIPTION OF THE DRAWING

The drawing is a schematic representation of a solvent dewaxing process employing improvements of the present invention.

DESCRIPTION OF TERMS

Intermediate waxy petroleum distillate oil stocks contemplated as charge stocks to the solvent dewaxing process of the present invention, have a viscosity of about 200–350 SUS at 100° F (38° C); and have a boiling range of about 625° F (330° C) initial boiling point to about 1100° F (593° C) endpoint. Such light waxy petroleum distillate oil stocks may be derived from raw lube oil stocks the major portion of which boil above 650° F (343° C). Such raw lube oil stocks can be vacuum distilled with overhead and side draw distillate streams and a bottom stream referred to as residual oil stock. Considerable overlap in boiling ranges of distillate streams and the residual stream may exist, depending upon distillation efficiency. Some heavier distillates have almost the same distribution of molecular species as the residual stream. Preferably, paraffinic crude oils are used as sources of lube oil stocks.

Such distillate streams contain aromatic and polar compounds which are undesirable in lubricating oils. Such compounds may be removed, by means such as solvent extraction, hydrogenation, and other means well known in the art, either before or after solvent dewaxing. Treatment of distillate streams for removal of aromatic and polar compounds before solvent dewaxing reduces the volume of oil to be dewaxed, which concomitantly reduces the amount of solvent employed, heat load, etc.

The wax content of a waxy distillate oil stock is defined by the amount of material to be removed to produce a dewaxed oil with a selected pour point temperature in the range of +25° to −40° F (−3.9° to −40° C). Wax content of waxy distillate oil stock will vary in the range of 5 to 35 wt. percent. The wax material removed in solvent dewaxing is a complex mixture of straight chain and branched chain paraffin and naphthenic hydrocarbons. Waxes in light distillate oil stocks generally predominantly comprise normal paraffin hydrocarbons which have relatively high crystal growth rates. Whereas waxes in heavier oil stocks are mixtures of normal and isoparaffin hydrocarbons which have generally slower crystal growth rates. In solvent dewaxing processes, wax is separated as solid crystals.

Dewaxed oil, as the term is used herein, is the product from the dewaxing process after solid wax and solvent have been removed.

Pour point is the temperature at which an oil will cease to flow when chilled under prescribed conditions (ASTM-D-97-66). The pour point temperature of an oil stock is reduced in a solvent dewaxing process by removing wax therefrom. The pour point temperature of dewaxed oil determines the useful temperature range of lubricating oil manufactured therefrom, and is indicative of other properties such as viscosity, etc.

The cloud point is the temperature at which a cloud or haze of wax crystals first appears when a wax containing oil is cooled under prescribed conditions (ASTM-D-2500-66). The cloud point of a waxy oil stock may be depressed by addition of solvent in which oil and wax are soluble. The amount of cloud point depression is dependent upon degree of dilution with solvent, nature of feedstock, type or mixture of solvents employed, etc.

Dewaxing solvents which may be used in the process of the present invention may be selected from: aliphatic ketones of 3 to 6 carbon atoms; lower molecular weight hydrocarbons, e.g., ethane, propane, butanes, and particularly propylene; aromatic hydrocarbons such as benzene and toluene; halogenated low molecular weight hydrocarbon of 1 to 4 carbon atoms, e.g., dichloroethane, methylene chloride, etc.; and mixtures of the above. Particularly useful dewaxing solvent mixtures are: mixtures of methyl ethyl ketone and methyl isobutyl ketone; mixtures of ketones with propylene; mixtures of ketone with $C_6$–$C_7$ aromatic hydrocarbons and mixtures of dichloroethylene and methylene chloride. Particularly useful in the process of the present invention are mixtures comprising 30–70 volume percent methyl ethyl ketone and 70–30 volume percent toluene.

Solvent dilution, within contemplation of the present invention, comprises diluting the waxy oil charge stock with solvent, in volume ratios in the range of about 1:1 to 5:1 solvent to oil, for improving wax removal from the oil, maintaining fluidity of the oil under cooling, or chilling, conditions in the process, obtaining optimum wax separation rates, and obtaining optimum dewaxed oil yields. The extent of solvent dilution is dependent upon the particular waxy oil stock, the solvent system employed, the extent of cooling in the cooling zone, and the desired final viscosity of the wax/oil/solvent mixture going to the wax separation zone. In the prior art it is known that solvent may be added to waxy oil stock before cooling commences, (referred to as predilution), in increments as the oil stock is cooled, at the exit from the cooling zone, or by a combination of the above methods. One solvent may be added at one point in the solvent dewaxing process and another at another point, or the same solvent or mixture of solvents, may be employed throughout. Generally, it has been observed that addition of a cold solvent (e.g., in range of +20° to −20° F or −6.7° to −29° C) to a warmer waxy oil stock, must be accompanied by vigorous agitation for formation of large, easily separated wax crystals. Without vigorous agitation, such cold solvent injected into waxy oil stock tends to form extremely small wax crystals which are difficult to separate.

Plug Flow Radial Mixing within contemplation of the present invention refers to mixing the solvent-oil mixture in a tubular mixing zone by splitting the flowing fluid into two or more strata each of which is then helically rotated in one direction about its hydraulic center resulting in radially mixing the flowing fluid such that fluid is forced from the center of the tubular mixing zone outward to the outer wall of the tube, and vice versa, then splitting these strata into two or more additional strata, each of which is then helically rotated in the opposite direction about its hydraulic center, etc. The overall effect of such mixing is to cause the flowing stream to be continuously divided and redivided into strata which are continuously radially inverted, such that elements of the fluid entering at the center of the flowing stream are forced to the outer wall, and vice versa, on a continuous basis. Such radial mixing is accomplished with very little backmixing such that the flow of fluid approximates plug flow. Flow of fluid may be in the laminer range or in the turbulent range. In such plug flow radial mixing, transverse gradients in temperature, velocity and composition are substantially reduced or eliminated. Additionally, heat transfer from the body of flowing fluid to the wall of the mixer is substantially increased. Mechanical devices to accomplish such plug flow radial mixing may be obtained from Kenics Corporation, and are described in "MOTIONLESS MIXERS FOR VISCOUS POLYMERS", Chen and MacDonald, *Chemical Engineering*, Mar. 19, 1973, p. 105ff. In the present invention, plug flow radial mixing makes three important contributions to the process. Transverse temperature differences across the flowing fluid are reduced to about 1° F (0.56° C) or less in the cooling zone such that super cooled oil-solvent mixture does not reside at the cold wall depositing wax thereon; the flow of oil-solvent mixture is directed at the cold wall, scouring away and wax which may accumulate; and, in the mixing zone, solvent and oil are rapidly blended into a mixture having a uniform temperature and composition throughout.

Cooling Rate of a waxy oil stock-solvent mixture of solution, in solvent dewaxing processes generally and the process of the present invention particularly, has been observed to be determinate of the size of wax crystals formed in the wax/oil/solvent mixture. Lower cooling rates yield larger, easy to separate crystals, with less oil occluded therein. Conventionally, oil-solvent mixtures are cooled at uniform slow rates in the range of 1°–8° F per minute (0.56° to 4.4° C/min.). Preferably cooling rates are in the range of 1.5°–5° F per minute (0.83° to 2.78° C/min.). Although larger wax crystals containing less occluded oil are formed at lower cooling rates, economy demands that the rate be at least about 1° F per minute (0.56° C/min.). At cooling rates above about 8° F per minute (4.4° C/min.), the wax crystals formed are small, difficult to separate and contain much occluded oil. Nucleation of new wax crystals and growth of existing wax crystals from an oil-solvent mixture are both proportional to the degree of supersaturation of wax in the oil-solvent mixture. As the oil-solvent mixture is cooled, wax crystallization as new nuclei or as growth of existing crystals, lags as a result of mass transfer, such that the mixture is somewhat supersaturated. Nucleation of new wax crystals is favored over crystal growth at higher degrees of supersaturation which result from higher cooling rates. Thus, the lowest economical cooling rate is to be preferred. When waxy oil stock, or oil-solvent mixtures are cooled to the cloud point, a very large number of small wax crystal nuclei precipitate forming a haze or cloud in the mixture. Under conditions of uniform slow cooling, in the 1°–8° F per minute (0.56° to 4.4° C/min.) range, these small crystals tend to grow into larger, easily separable crystals at the expense of formation of additional small wax crystal nuclei as the temperature is reduced.

DESCRIPTION OF THE DRAWING

For better understanding the process of the present invention reference is now made to the drawing. The drawing is a schematic representation of a solvent dewaxing process employing improvements of the present invention, and only those elements of the process necessary for an understanding of the present invention are included. Mechanical features and process equipment unnecessary for an understanding of the present invention have been omitted for the sake of clarity. The drawing, and the description which follows are intended to demonstrate an embodiment of the present invention, and are not to be construed as limitations of the invention which is set-out in the claims appended to this application.

In the drawing, intermediate waxy petroleum distillate oil stock (waxy oil stock) having physical properties within ranges heretofore set-out in this specification, and undiluted with dewaxing solvent, flows continuously, via line 1, into heating zone 2. In heating zone 2, the waxy oil stock is heated by indirect heat exchange to a temperature at which all wax present is melted and completely liquid solution results, e.g., 85° to 160° F (29° to 71° C) for waxy oil stocks within contemplation of the present invention.

In the drawing, heated waxy oil stock having all wax dissolved therein, flows from heating zone 2, via line 3, into the inlet of mixing zone 6. Dewaxing solvent, from line 4, having a temperature in the range of about 50°-80° F, (10° to 27° C), in an amount equivalent to about 1 to 4 volumes waxy oil stock is injected, via nozzle 5 into the inlet of mixing zone 6.

Dewaxing solvent herein is selected from known dewaxing solvents, as heretofore set-out in this specification. Particularly useful dewaxing solvents are mixtures comprising about 30–70 volume percent methyl ethyl ketone, and about 70–30 volume percent toluene, although other dewaxing solvents such as mixtures of methyl ethyl ketone and methyl isobutyl ketone, and mixtures of ethylene dichloride and methylene chloride may be used to advantage. The amount of solvent may be in the range of 1–4 volumes of waxy oil stock, and, for example, is commonly in the range of about 2–4 volumes of waxy oil stock when the solvent is a mixture of methyl ethyl ketone-toluene. Dilution of lighter and heavier waxy oil stocks within the range of intermediate waxy petroleum distillate oil stocks within contemplation of the present invention may require respectively somewhat less or somewhat more solvent for optimum effectiveness. Preferably, the temperature of solvent entering mixing zone 6, within the range of about 50°-80° F, (10° to 26° C) is selected such that the resulting oil-solvent mixture leaving mixing zone 6 will be at a temperature below the depressed cloud point. Preferably, in the range of about 5°-10° F (2.8° to 5.6° C) below the depressed cloud point. Depressed cloud point temperatures for solvent waxy oil stock solutions within contemplation of the present invention will be in the range of about 70° to 125° F (21° to 51° C). Direct cooling of waxy oil stock with solvent by mixing according to the process disclosed herein results in forming wax crystals having very little oil occluded therein and which are easily separated from the oil-solvent mixtures. This advantage, which forms an impetus for the improved process of the invention will be discussed in more detail throughout this description of the invention.

In the drawing, in mixing zone 6, waxy oil stock is mixed intimately with the dewaxing solvent from nozzle 5 under conditions of plug flow radial mixing to form a solution of oil and solvent and to cool this solution below the depressed cloud point such that a haze of wax crystal nuclei is present in the oil-solvent mixture exiting mixing zone 6. Dewaxing solvent is injected into the waxy oil stock flowing into mixing zone 6 as a spray of fine droplets from nozzle 5. Many nozzles designed for dispersing liquids as a sprays of fine droplets are commercially available and are suited for use in this service. Wax nuclei crystallize under these conditions, and the oil forms a solution with the solvent. Plug flow radial mixing distributes the wax crystals throughout the flowing stream.

In the drawing, the wax nuclei-oil-solvent mixture from mixing zone 6 flows via line 7 into cooling zone 8 for crystallization of additional wax from said mixture. In cooling zone 8, the mixture is cooled at a uniform rate in the range of 1°-8° F per minute (0.56° to 4.4° C/min.), preferably 1.5°-5° F per minute (0.83° to 2.8° C/min.), to a selected separation temperature in the range of 25° to −40° F (−3.9° to −40° C). During this cooling step, additional wax crystallizes from the oil-solvent mixture thus decreasing the pour point of oil remaining in solution with the solvent. A major portion of wax crystallized in cooling zone 8 accumulates on wax nuclei already present, causing them to grow into easily separable wax crystals. Cooling in cooling zone 8 is continued until sufficient wax is crystallized such that the dewaxed oil product has a desired pour point in the range of 0° to −25° F (−17.8° to −31.7°) or lower. Cooling in cooling zone 8 is preferably via indirect heat exchange with a refrigerant fluid or may be by direct heat exchange by vaporizing a portion of a low boiling dewaxing solvent, such as propylene, at reduced pressure.

In the drawing additional dewaxing solvent is added to the cold wax/oil/solvent mixture exiting mixing zone 8 for adjusting the solvent dilution ratio of the mixture. Additional solvent may be found desirable for reducing viscosity of the wax/oil/solvent mixture, and for increasing the amount of wax crystallization, etc. Thus, wax/oil/solvent mixture, at the selected separation temperature, flows via line 9 into the inlet of second mixing zone 18. Dewaxing solvent from line 20, in an amount equivalent to about 1 to about 2 volumes of waxy oil stock, at or a few degrees below the selected separation temperature, is injected, via nozzle 21 into the inlet of mixing zone 18. The wax/oil/solvent mixture is mixed intimately with the dewaxing solvent from nozzle 21 in mixing zone 18 under conditions of plug flow radial mixing to form a homogeneous mixture of wax crystals in oil/solvent solution. Dewaxing solvent is injected into mixing zone 18 as a spray of fine droplets from nozzle 21. Plug flow radial mixing distributes wax crystals throughout the flowing stream and intimately mixes oil and solvent to form a solution. From second mixing zone 18 wax/oil/solvent mixture, at the selected separation temperature, flows via line 19 into solid-liquid separation zone 10 for separation into a wax cake (slack wax) and oil/solvent filtrate. Solid-liquid separation may be accomplished by solid-liquid separation methods known in the art, such as gravity settling, centrifugal separation, filtration, etc. Preferably, and commonly practiced in commercial processes, wax is separated from oil-solvent solutions by vacuum filtration. That is, wax-oil-solvent mixture at the separation temperature flows into a holding tank of a rotary vacuum filter having a rotating filter drum covered with a filter cloth. Oil-solvent solution is pulled through the filter cloth by an imposed vacuum, and wax accumulates upon the cloth as a filter cake. As the drum rotates out of the holding tank, additional oil-solvent solution entrained in the filter cake is pulled through the cloth, and commonly wash solvent is sprayed upon the filter cake to displace additional oil. Wash solvent, which may be the same or different from the dewaxing solvent, is likewise pulled through the filter cloth by vacuum action, carrying dissolved oil with it. After the solvent wash, air may be drawn through the wax filter cake for evaporating residual wash solvent, thereby drying the wax cake. At the end of the filter cycle, the wax cake is removed from the filter cloth by a blast of pressurized air, or by a scraper such as a doctor knife, and the rotating drum carries the filter cloth into the holding tank for contact with additional wax-oil-solvent mixture.

In the drawing, wax from solid-liquid separation zone 10, known as slack wax and containing some oil entrained therein, is recovered via conduit 11 for further refining or for recovery as is. Wax free oil-solvent filtrate from solid-liquid separation zone 10, flows via line 12 to fractionation zone 13. In fractionation zone 13, the oil-solvent solution is separated into a solvent fraction which is recovered via overhead line 14, and a dewaxed oil fraction which is recovered as product via line 15.

In the process of the present invention, it is contemplated that waxy oil charge stock will be suitable for manufacture of lubricating oils. Thus, a particular waxy oil charge stock will have a boiling range, viscosity, and composition suitable for manufacturing a particular lubricating oil. Solvent dewaxing is performed for removing wax from the waxy charge stock, thereby lowering the pour point temperature to a value suitable for the particular lubricating oil being manufactured. Other refining processes, outside the scope of the present invention, such as solvent extraction, hydrogenation, etc., are commonly performed on the waxy oil charge stock and/or the dewaxed oil for adjusting other properties of the oil, such as viscosity index, to values suitable for the particular lubricating oil.

Production of lubricating oils is relatively low volume operation compared to other petroleum refining operations. Consequently in commercial solvent dewaxing operations it is common practice to process one waxy oil stock at one time and other waxy oil stocks at other times, in blocked out operation.

Heating waxy oil stock in heating zone 2 is preferably by indirect heat exchange from a heating medium, such as steam, hot gas, or other heat transfer fluid, to the waxy oil stock. Heating zone 2 may conveniently be a heat exchanger such as a shell and tube exchanger, a double pipe exchanger, etc., or heating zone 2 may comprise heating coils suspended in a waxy oil stock storage tank. Heat is transferred from the heating fluid to the waxy oil stock primarily by convection. Maximum temperatures necessary for dissolving all the wax in the waxy oil stocks contemplated for processing according to the present invention do not exceed about 160° F (71° C) and commonly do not exceed about 130° F (54.4° C). Consequently, heat exchangers having high radiant heat flux, and hot tube walls, such as direct fired heaters, are not preferred for this service.

Plug flow radial mixing, as previously described for use particularly in first mixing zone 6 and second mixing zone 18, comprises a series of steps wherein the flowing stream to be mixed is divided into strata, and each strata is rotated about its hydraulic center, forcing liquid from the center of the flowing streams to the outer walls, and liquid from the outer walls to the center. The next succeeding mixing step redivides the strata from the first step into new divisions, each comprising portions of all the strata from the first step, and rotates the new divisions in the opposite direction about their hydraulic center. Thus, in each mixing step, each strata of the liquid (in this case, waxy oil stock and solvent) is mixed, and in the next succeeding step, portions of each strata are mixed with each other. In order to obtain the degree of mixing desired for waxy oil and solvent in the present process, from about 100,000 to about 1,000,000 divisions and redivisions (strata) of the waxy oil and solvent are required. This degree of mixing requires from about 9 to about 20 mixing elements in the plug flow radial mixers. The number of mixing elements will be determined by the degree of mixing and the type of mixer selected. Some commercially available plug flow radial mixers divide the flow into two strata at each step, and some mixers divide the flow into four strata at each step.

In plug flow radial mixing, a discreet amount of mixing is accomplished by each element at each step. Thus, unlike agitation, where more or less mixing at each stage can be accomplished by increasing or decreasing residence time and/or agitator speed in that stage, residence time does not contribute substantially to the degree of mixing. In plug flow radial mixing, the liquid to be mixed must pass through a certain number of stages for a certain degree of mixing. In the present invention, relatively rapid mixture of waxy oil into solvent in the mixing zones is desirable. As each element of the plug flow radial mixers occupies a length of equivalent about 1.5 diameters of the tubular mixing zone, and as mixing zones for commercial scale solvent dewaxing units may conveniently be about six inches (15.24 cm.) in diameter, a minimum velocity of about 0.5 ft./sec. (0.15 m./sec.) for solvent and oil in the mixing zone is desirable. Stated in a more generalized way, the preferred minimum velocity of solvent and oil in the mixing zone is equivalent to about one mixing zone diameter per second. A maximum to the flow velocity of waxy oil and solvent in the mixing zone is also desirable. This maximum is preferably equivalent to about eight mixing zone diameters per second, e.g. about 4 ft./sec. (1.22 m./sec.) for a 6 inch (15.24 cm.) diameter. Upon injection of solvent into the oil, small regions of temperature discontinuities develop, which are equilibrated as the oil and solvent are thoroughly mixed. In cooler regions, wax nuclei will form, while in warmer regions wax will remain in solution. As the oil and solvent are mixed and the temperature equilibrates some of the lower melting point wax nuclei formed in the cooler regions will melt and some wax from the warmer regions will crystallize as wax nuclei. This melting and crystallization of wax, that is equilibrating of wax nuclei, takes a little time, and it is desirably completed in the mixing zone. The maximum velocity equivalent to about eight mixing zone diameters gives sufficient time for the wax nuclei to equilibrate as the waxy oil-solvent temperature is equilibrated.

Cooling in cooling zone 8 is preferably via indirect heat exchange with a refrigerant fluid, in double pipe heat exchangers. However, cooling by direct heat exchange, such as with vaporizing low boiling solvent at reduced pressure, may also be employed. In the preferred embodiment, such double pipe heat exchangers may be equipped with scrapers for removing any deposited wax from the cold exchanger walls. Preferably, however, such rotating mechanical equipment is replaced with stationary plug flow radial mixers. Plug flow radial mixing of the wax-oil-solvent mixture in cooling zone 8 reduces transverse temperature differentials across the flowing mixture to about 1° F or less, such that super cooling of the mixture at the cold wall, and concomitant precipitation of low melting point wax at the cold wall, are avoided. Precipitation of low melting point wax, in a cold zone near the cold wall produces two undesirable effects. The low melting point wax, when exposed to warmer oil-solvent mixture becomes tacky or sticky. This sticky wax then tends to stick to the cold wall of the exchanger, contributing to wax build-up, decreased heat exchange rates, increased pressure drops, etc. Also, the sticky wax tends to agglomerate into irregular shaped larger particles containing substantial amounts of occluded and entrained oil, thereby contributing to decreased dewaxed oil product yields. As stated above, plug flow radial mixing of the wax-oil-solvent mixture in the cooling zone eliminates stagnant cold liquid at the walls of the heat exchanger, thus the low melting point wax does not tend to precipitate until the entire body of flowing solvent-oil mixture is cooled to the crystallization temperature. Consequently the wax crystals formed do not tend to accumulate on the heat exchanger walls. Also, in plug flow radial mixing, the flowing mixture is directed at the heat exchanger walls, thus scouring away any wax which may accumulate thereon. Additionally, with plug flow radial mixing in the cooling zone, wax tends to crystallize evenly throughout the flowing wax-oil-solvent mixture such that mass transfer of crystallizing wax from oil-solvent solution to an existing wax crystal is improved. Such improved mass transfer increases the growth rate of wax crystals and decreases the rate of wax crystal nuclei formation in the cooling zone.

EXAMPLE

In order to demonstrate the process of the present invention, the following example is provided. A wax distillate oil of SAE-20 grade, derived from Arabian Light crude is dewaxed according to the process of the present invention. Physical properties of the SAE-20 grade oil are given in Table I, below:

TABLE I

| | SAE-20 Grade Oil |
|---|---|
| API Gravity | 31.0 |
| Viscosity, SUS 100° F | 254.0 |
| SUS 210° F | 50.8 |
| Viscosity Index | 109.0 |
| Pour Point, or | 110.0 |
| Cloud Point, ° F | 115.0 |
| Wax Content, Wt.% | 12.9 |

In the example process, SAE-20 grade oil is heated to a temperature of about 120° F (49° C) for melting all wax present therein. A continuous flow of heated SAE-20 grade oil passes into a first mixing zone. A continuous stream of solvent, comprising 70 volume percent MEK and 30 volume percent toluene, is flowed at a rate equivalent to 1.0 times the flow rate of heated into, the mixing zone at an entering temperature of 65° F (18° C). The mixing zone comprises a pipe having a nozzle for injection of dewaxing solvent near its inlet, and having Kenics (TM) mixers of 20 elements following the injection nozzle. The nozzle is a restriction orifice which distribute the injected solvent as fine droplets into the flowing oil.

The oil-solvent mixture exits the mixing zone at a temperature below the depressed cloud point of the mixture, such that a haze of wax nuclei is present in the mixture. The mixture is flowed through a cooling zone comprising double pipe exchangers having Kenics (TM) mixers therein, wherein the mixture is cooled at a rate of 4.0° F/min. (2° C/min.) to a temperature of −4° F (−20° C). In the cooling zone additional wax is crystallized causing the wax nuclei to grow into filterable crystals.

From the cooling zone, the wax-oil-solvent mixture flows into a second mixing zone at −4° F (−20° C). A second stream of solvent, comprising 70% MEK and 30% toluene, flows into said second mixing zone at a rate equivalent to 1.0 times the SAE-20 charge rate, at a temperature of −4° F (−20° C). In the second mixing zone, the wax-oil-solvent mixture and second stream of solvent are intimately mixed for precipitating additional wax. The second mixing zone comprises a pipe having a nozzle for injecting solvent near its inlet, and having 20 Kenics (TM) static mixing elements following the injection nozzle.

From the second mixing zone, the wax-oil-solvent mixture is transferred to a vacuum filter operating at 400 mm. Hg. pressure wherein wax is filtered from the oil-solvent mixture. Upon filtration, the wax filter cake is washed with an amount of solvent equivalent to 0.65 volumes of SAE-20 grade oil charge, and the solvent washed wax cake is air dried under vacuum for 60 seconds. Dewaxed oil is recovered from the wax free oil-solvent filtrate by fractional distillation.

Results of this experiment are shown in Table II, below:

TABLE II

| Dilution Ratio (vol. solv. vol. SAE-20 | Cooling Rate (° F.min) | Filter Temp. (° F) | Wax Cake Wash Ratio (vol. solv.) (vol. SAE-20) | Dewaxed Oil Pour Point (° F) | Dewaxed Oil Yield (vol% SAE-20) | Filter Rate Gal dewaxed oil/ ft² filter/hr |
|---|---|---|---|---|---|---|
| 2.0 | 4.0 | −4 | 0.65 | +15 | 75 | 12.7 |

We claim:

1. In a continuous process for separating wax from an intermediate waxy distillate oil stock wherein said waxy oil stock is treated with dewaxing solvent, in a solvent to oil ratio of about 1:1 to about 5:1, and is cooled to a selected separation temperature for crystallizing wax from said waxy oil, and forming a wax/oil/solvent mixture, wherein said wax/oil/solvent mixture is separated, in a solid-liquid separation zone into solid wax and a wax free oil solvent mixture, and wherein said wax free oil-solvent mixture is fractionated, in a fractionation zone, for producing a solvent fraction and a dewaxed oil fraction; the improvement which comprises:

(a) heating, in a heating zone, said waxy oil charge to a temperature sufficient to melt all wax therein;

(b) mixing, in a first mixing zone, said heated waxy oil with a first stream of dewaxing solvent having a temperature of 60°–80° F, in a solvent to oil ratio of from about 1:1 to about 4:1 under conditions of plug flow radial mixing sufficient to provide a homogeneous mixture of oil and solvent at a temperature below the depressed cloud point;

(c) cooling, in a cooling zone, said solvent-oil mixture at a rate of 1°–8° F per minute to said selected separation temperature, for crystallizing wax and forming a first wax/oil/solvent mixture;

(d) mixing, in a second mixing zone, said first wax-/oil/solvent mixture with a second stream of solvent in an amount equivalent to about 1–2 volumes of waxy oil charge, at about the selected separation temperature, for crystallizing additional wax and forming a second wax/oil/solvent mixture; and (e) flowing said second wax/oil/solvent mixture, at said selected separation temperature to said solid-liquid separation zone.

2. The method of claim 1 wherein said solvent-oil mixture is cooled, under conditions of plug flow radial mixing, in said cooling zone by indirect heat exchange.

3. The method of claim 2 wherein mixing of said first wax/oil/solvent mixture with said second solvent stream is under conditions of plug flow radial mixing.

4. The method of claim 3 wherein said homogeneous mixture of oil and solvent of step (b) is at a temperature in the range of about 5°-10° F (2.8° to 8.6° C) below the depressed cloud point, and wherein said selected separation temperature of step (c) is in the range of about 0° to −40° F (−18° to −40° C).

* * * * *